US006737810B2

(12) United States Patent
Hochi et al.

(10) Patent No.: US 6,737,810 B2
(45) Date of Patent: May 18, 2004

(54) ELECTRODELESS DISCHARGE LAMP APPARATUS WITH ADJUSTABLE EXCITING ELECTRODES

(75) Inventors: Akira Hochi, Nara (JP); Kiyoshi Hashimotodani, Takatsuki (JP); Koichi Katase, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 68 days.

(21) Appl. No.: 10/011,587

(22) Filed: Oct. 30, 2001

(65) Prior Publication Data

US 2002/0135322 A1 Sep. 26, 2002

(30) Foreign Application Priority Data

Oct. 30, 2000 (JP) ..... 2000-330210

(51) Int. Cl.[7] ..... H01J 65/04
(52) U.S. Cl. ..... 315/39; 315/248
(58) Field of Search ..... 315/39, 248

(56) References Cited

U.S. PATENT DOCUMENTS 3,993,927 A 11/1976 Haugsjaa et al. ..... 315/39
4,427,920 A * 1/1984 Proud et al. ..... 315/248
4,427,925 A * 1/1984 Proud et al. ..... 315/248
5,113,121 A * 5/1992 Lapatovich et al. ..... 315/248
5,814,951 A 9/1998 Smolka et al. ..... 315/326
6,049,170 A 4/2000 Hochi et al. ..... 315/39

FOREIGN PATENT DOCUMENTS

JP 05062649 A 3/1993
JP 9-190803 7/1997
JP 10-189270 7/1998

* cited by examiner

*Primary Examiner*—Benny T. Lee
(74) *Attorney, Agent, or Firm*—Harness, Dickey & Pierce, P.L.C.

(57) ABSTRACT

An electrodeless discharge lamp apparatus includes an electrodeless discharge lamp, a microwave resonator, and a microwave coupler. The microwave resonator includes a conductive reflecting mirror having an opening, a conductive shield, and two opposing external electrodes provided substantially on a central axis of the reflecting mirror. The electrodeless discharge lamp is disposed between the opposing external electrodes. The focal point of the reflecting mirror is positioned between the opposing external electrodes. When microwave energy is supplied to the microwave resonator via the microwave coupler, a microwave resonant electric field occurs between the opposing external electrodes, whereby discharge of the electrodeless discharge lamp occurs.

16 Claims, 9 Drawing Sheets

PRIOR ART

ELECTRODELESS DISCHARGE LAMP APPARATUS WITH ADJUSTABLE EXCITING ELECTRODES

BACKGROUND OF THE INVENTION

The present invention relates to an electrodeless discharge lamp apparatus using microwaves.

An electrodeless discharge lamp has no electrode inside a discharge space, and therefore blackening on the inner wall of a bulb due to evaporation of electrodes does not occur. Thus, it is possible to prolong the lamp life significantly. With this feature, electrodeless discharge lamps have been under in-depth research as the next generation high-intensity discharge lamp in recent years. In discharge lamp apparatuses in general, as the light emitting portion is smaller, the lamp is closer to a point light source and thus ideal luminous intensity distribution can be designed. Therefore, there is strong demand for reduction in the size of plasma, which is a light emitting portion.

In the case of an electrodeless discharge lamp apparatus using microwaves (microwave-excited lamp apparatus), microwaves are generated by magnetron and are passed through a wave guide to cause discharge in an electrodeless discharge lamp in a cavity resonator for light emission. In the case of this lamp apparatus, the minimum size of the cavity resonator is, in principle, determined by the frequency of the microwaves. For an electrodeless discharge lamp using microwaves of 2.45 GHz (wavelength of 122 mm), which is commonly used, it is known empirically that the size of a plasma arc that can maintain stable discharge is limited to about 15 mm or more. This size of the plasma arc is far from the size of the plasma arc that can be designed as being regarded as a point light source (e.g., 3 mm or less) in the optical design.

In the electrodeless discharge lamp apparatus using microwaves, a technique disclosed in Japanese Laid-Open Patent Publication No. 10-189270 is known that can realize a small sized light-emitting portion. Hereinafter, the electrodeless discharge lamp apparatus disclosed in this publication will be described with reference to FIG. 10.

FIG. 10 schematically shows the structure of high frequency energy supplying means that is a component of the electrodeless discharge lamp apparatus disclosed in this publication. The high frequency energy supplying means shown in FIG. 10 includes a plurality of side resonators and supplies microwave energy necessary for discharge by a resonant microwave electric field in the center of the ring of the side resonators. This structure allows the microwave resonant electric field to be supplied while being concentrated on a space smaller than when using a cavity resonator.

The high frequency energy supplying means shown in FIG. 10 is a vane-type resonator, and this vane-type resonator has a structure in which four plate-like vanes 52 made of conductive material extend toward the center from the surface of the inner wall of a member 53 that serves as a reflecting mirror and also serves as a shield for preventing leakage of microwaves. The member 53 is made of conductive material as well and has a circular and rotationally symmetric shape. One of the vanes 52 is joined to a core line of a wave guide 54 by soldering or the like, and thus the vane and the core line are electrically connected so that microwave energy coupling means (microwave coupler) 55 is formed. The microwave energy coupling means 55 acts as an oscillating antenna in the resonator, so that microwave energy propagated through the wave guide 54 is coupled to the vane-type resonator. The size of the vane-type resonator is designed such that resonance occurs at the frequency of the microwave energy to be coupled.

An electrodeless discharge lamp 51 is a lamp in which a luminous material such as a metal halide and a rare gas are enclosed inside a hollow spherical quartz glass. The electrodeless discharge lamp 51 is placed in a microwave resonant electric field generated in the center of the vane-type resonator so that microwave energy is supplied to the electrodeless discharge lamp 51. Thus, discharge is caused by the gas in the electrodeless discharge bulb 51 so that light is emitted. The radiated light due to the discharge is reflected by the reflecting mirror 53 made of a conductor and is released out through a metal net 56. The reflecting mirror 53 in combination with the metal net 56 acts as microwave leakage prevention means.

According to this high-frequency energy supplying means, in the electrodeless discharge lamp, plasma of a comparatively small size of 10 mm or less can be discharged and maintained.

However, as a result of examination of the inventors of the present application, it was found that the system using the side resonators as shown in FIG. 10 has the following problems. First, it is necessary to provide a protruded portion of the side resonators perpendicularly to the central axis of the reflecting mirror with a curved surface, so that even if plasma of a comparatively small size can be discharged and maintained, the structure thereof is complicated. This complication of the structure is detrimental to mass production and increases the cost. Furthermore, in this structure, the light that is radiated toward the reflecting mirror in the direction of the side of the electrodeless discharge lamp is shielded by the protruded portion of the side resonators, and therefore the projected light has shadows of the protruded portion. As a result, problems such as a reduction in the amount of light and non-uniformly distribution of light are caused.

SUMMARY OF THE INVENTION

It is an object of the present invention to provide an electrodeless discharge lamp apparatus with a comparative simple structure having excellent luminous intensity distribution properties.

An electrodeless discharge lamp apparatus of the present invention includes a) an electrodeless discharge lamp having no electrode exposed inside a discharge bulb; b) a microwave resonator; and c) a microwave coupler for coupling microwave energy to the microwave resonator. The microwave resonator includes a conductive reflecting mirror having an opening; a conductive shield covering the opening of the reflecting mirror and transmitting light in at least a portion thereof; and two opposing external electrodes provided substantially on the central axis of the reflecting mirror. The electrodeless discharge lamp is disposed between the opposing external electrodes. The focal point of the reflecting mirror is positioned between the opposing external electrodes. When microwave energy is supplied to the microwave resonator via the microwave coupler, a microwave resonant electric field occurs between the opposing external electrodes, whereby discharge of the electrodeless discharge lamp occurs.

Another electrodeless discharge lamp apparatus of the present invention includes a) an electrodeless discharge lamp having no electrode exposed inside a discharge bulb; b) a microwave resonator; c) a microwave coupler for coupling microwave energy to the microwave resonator; and d) a reflecting mirror provided outside the microwave resonator. The microwave resonator includes a conductive cylinder having an opening; a conductive shield covering the opening of the conductive cylinder and transmitting light in at least a portion thereof; and two opposing external electrodes provided substantially on the central axis of the conductive cylinder. The electrodeless discharge lamp is disposed between the opposing external electrodes. The focal point of the reflecting mirror is positioned between the opposing external electrodes. When microwave energy is supplied to the microwave resonator via the microwave coupler, a microwave resonant electric field occurs between the opposing external electrodes, whereby discharge of the electrodeless discharge lamp occurs.

It is preferable that the electrodeless discharge lamp is provided substantially on the central axis of the reflecting mirror and provided substantially on the central axis of the conductive cylinder.

It is preferable that a distance adjuster for adjusting the distance between the opposing external electrodes be provided external to the microwave resonator.

In one preferable embodiment, one of the opposing external electrodes serves also as the microwave coupler.

In one preferable embodiment, said one of the opposing external electrodes is made of a coaxial line, and the microwave coupler is a coaxial core line portion projected from one end of the coaxial line.

In one preferable embodiment, one of the opposing external electrodes serves also as supporting means of the electrodeless discharge lamp.

In one preferable embodiment, a starting probe is provided inside the supporting means.

In one preferable embodiment, the reflecting mirror is of a shape with an ellipsoidal surface.

In one preferable embodiment, a secondary reflecting mirror of a shape with a spherical surface with the electrocleless discharge lamp as the center thereof is further provided in front of the opening of the reflecting mirror, and the secondary reflecting mirror has an opening in a portion in which light is concentrated by the ellipsoidal surface of the reflecting mirror and in the vicinity thereof.

In one preferable embodiment, the electrodeless discharge lamp apparatus further includes cooling means for cooling the electrodeless discharge lamp.

In one preferable embodiment, the electrodeless discharge lamp apparatus includes a wave guide connected to the microwave coupler, wherein the wave guide has a function to propagate microwaves generated by a microwave oscillator.

Since the electrodeless discharge lamp apparatus of the present invention includes an electrodeless discharge lamp, a microwave resonator and a microwave coupler, and the microwave resonator includes two opposing external electrodes provided substantially on the central axis of the reflecting mirror, the present invention can have excellent luminous intensity distribution properties in a comparatively simple structure.

DETAILED DESCRIPTION OF THE INVENTION

Figure 1:
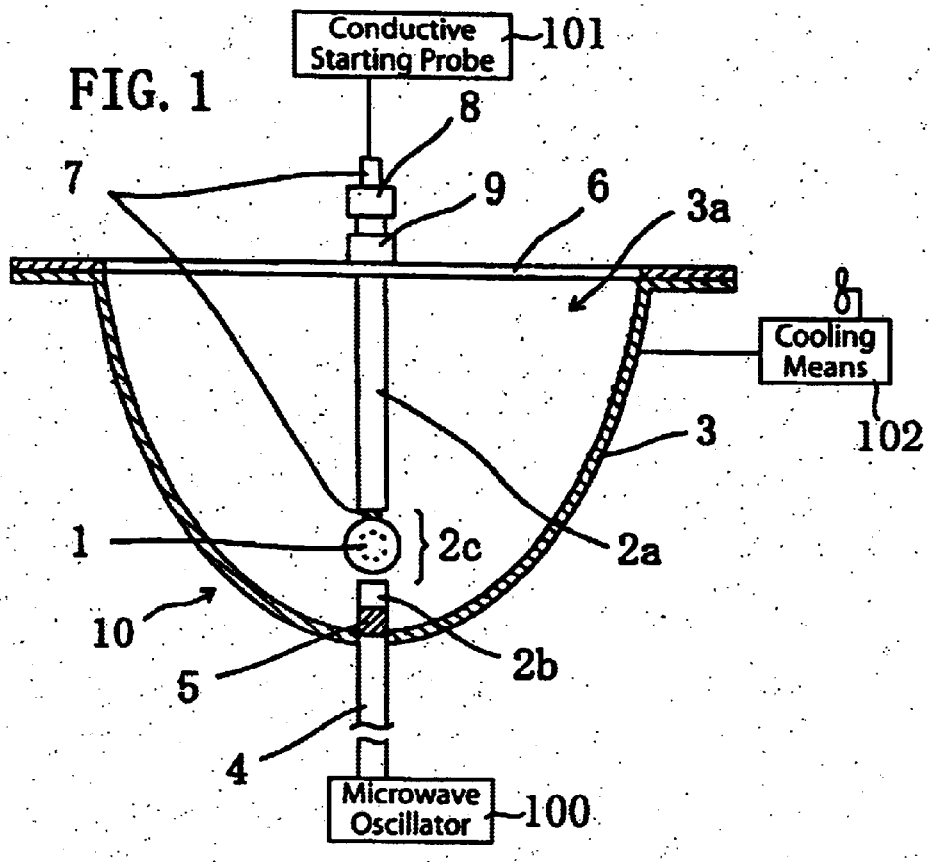
FIG. 1 is a schematic cross-sectional view showing a structure of an electrodeless discharge lamp apparatus of Embodiment 1 of the present invention.

Hereinafter, embodiments of the present invention will be described with reference to the accompanying drawings. For simplification of description, the components having substantially the same function bear the same reference numeral and may not be described in detail for each drawing figure. The present invention is not limited by the following embodiments.

Embodiment 1

FIG. 1 schematically shows the cross-sectional structure of a microwave resonator of Embodiment 1 of the present invention and an electrodeless discharge lamp apparatus using the same.

The electrodeless discharge lamp apparatus of this embodiment includes an electrodeless discharge lamp 1, a microwave resonator 10, and a microwave coupler (microwave energy coupling means) 2*b*. The electrodeless discharge lamp 1 is a lamp having no electrodes exposed in the discharge bulb, and is, for example, an electrodeless discharge lamp enclosing a luminous material such as a metal halide inside a hollow spherical quartz glass. The microwave coupler 2*b* is provided with a function to couple microwave energy supplied through a coaxial line 4 to the microwave resonator 10, and is, for example, an antenna. When microwave energy is supplied to the microwave resonator 10 shown in FIG. 1 via the microwave coupler 2*b*, a microwave resonant electric field occurs between opposing external electrodes (2*a*, 2*b*), and thus discharge occurs in the electrodeless discharge lamp 1.

The microwave resonator 10 includes a conductive reflecting mirror (e.g., metal reflecting mirror) 3, a conductive shield 6 (e.g., metal mesh) covering an opening 3*a* of the reflecting mirror 3 and transmitting light in at least a portion thereof, and two opposing external electrodes (2*a*, 2*b*). In this embodiment, the reflecting mirror 3 is made, for example, of aluminum, and has a shape with an ellipsoidal surface. The opposing external electrodes (2*a*, 2*b*) are made of metal such as copper, and are provided substantially on the central axis of the reflecting mirror 3. In this embodiment, the opposing external electrodes (2*a*, 2*b*) made of copper are used, but opposing external electrodes made of aluminum can be used. In this embodiment, the opposing external electrodes (2*a*, 2*b*) are located on the central axis of the reflecting mirror 3, but can be located not only on the geometrically central axis, but also in the vicinity thereof.

A gap 2*c* is present between the opposing external electrodes (2*a*, 2*b*), and the electrodeless discharge lamp 1 is disposed in the gap 2*c*. The focal point on the ellipsoidal surface of the reflecting mirror 3 is positioned in the area of the gap 2*c*. Thus, the electrodeless discharge lamp 1 is positioned in the focal point of the reflecting mirror 3. The electrodeless discharge lamp 1 is supported by supporting means 7. In this embodiment, one of the external electrodes 2*a* serves also as the supporting means of the electrodeless discharge lamp 1, and as shown in FIG. 1, a supporting rod 7 for supporting the electrodeless discharge lamp 1 penetrates the inside of the external electrode 2*a* so that the supporting rod 7 supports the electrodeless discharge lamp 1. The external electrode 2*a* is secured with a fastener 9.

In this embodiment, the external electrode 2*a* is configured such that it can be adjusted externally of the microwave resonator 10. More specifically, means (distance adjuster) 8 for adjusting the distance between the opposing external electrodes (2*a*, 2*b*) is provided in a portion of the external electrodes 2*a*, and this adjusting means (or gap adjusting means) 8 can be, for example, a screw or a flat spring. The adjusting means 8 allows the position of the external electrode 2*a* to move in the direction of the axis while maintaining electrical contact. Thus, the distance of the gap 2*c* can be changed freely, and consequently the resonance frequency of the Ser. No. 10/011,587 microwave resonator 10 can be adjusted. In this embodiment, the external electrode 2*b* serves also as a microwave coupler. More specifically, the external electrode 2*b* is in electrical contact with the core line of the coaxial line 4, and the external electrode 2*b* and the outer conductor of the coaxial line 4 are insulated by an insulator (insulating portion) 5. Thus, the external electrode 2*b* can serve as an antenna, which is a microwave coupler. The coaxial line 4 is a wave guide for propagating microwaves, and is connected to a microwave oscillator 100 (e.g., magnetron) that generates microwaves.

Next, the operation of the electrodeless discharge lamp apparatus of this embodiment will be described. The microwave energy generated from the microwave oscillator 100 propagates through the coaxial line 4, and is coupled to the microwave resonator 10 through the external electrode 2*b* serving also as a microwave coupler. In this case, the sizes of the metal reflecting mirror 3 and the opposing external electrodes 2*a* and 2*b* are designed as appropriate such that the frequency of the microwaves to be coupled matches the frequency of the resonator 10. When the resonator 10 is thus designed as appropriate, a resonant electromagnetic field can be obtained in the resonator 10, as shown in FIG. 2.

Figure 2:
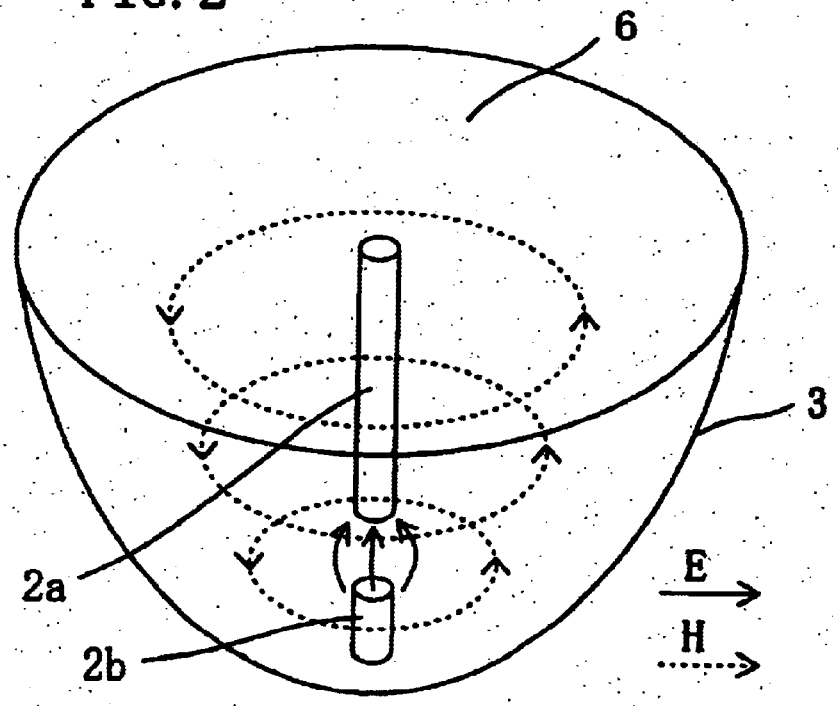
FIG. 2 is a perspective view showing an electromagnetic field inside a microwave resonator.

FIG. 2 schematically shows a resonant electric field E (shown by arrows of solid lines in FIG. 2) and a resonant magnetic field H (shown by arrows of dotted lines in FIG. 2) that are generated in the resonator 10. The resonant magnetic field H is spread in the entire microwave resonator 10 while rotating around the opposing external electrodes 2, whereas the resonant electric field E concentrates on the gap 2*c* of the opposing external electrodes 2.

Therefore, when the electrodeless discharge lamp 1 is provided in the gap 2*c* of the opposing external electrodes 2, the luminous material in the electrodeless discharge lamp 1 is excited for discharge and light emission. The light radiated by the discharge is reflected by the metal reflecting mirror 3 and released out through the shield 6. That is to say, according to the structure of this embodiment, the microwave resonant electric field can be supplied while being concentrated on a smaller space than when using a cavity resonator. Therefore, a light-emitting portion of a small size of 10 mm or less can be realized as in the case of the structure shown in FIG. 10. In addition, an electrodeless discharge lamp having a light-emitting portion of such a small size can be realized in a comparatively simple structure. Consequently, a microwave excitation type electrodeless discharge lamp having a structure that allows easy mass production and low cost can be realized.

Figure 10:
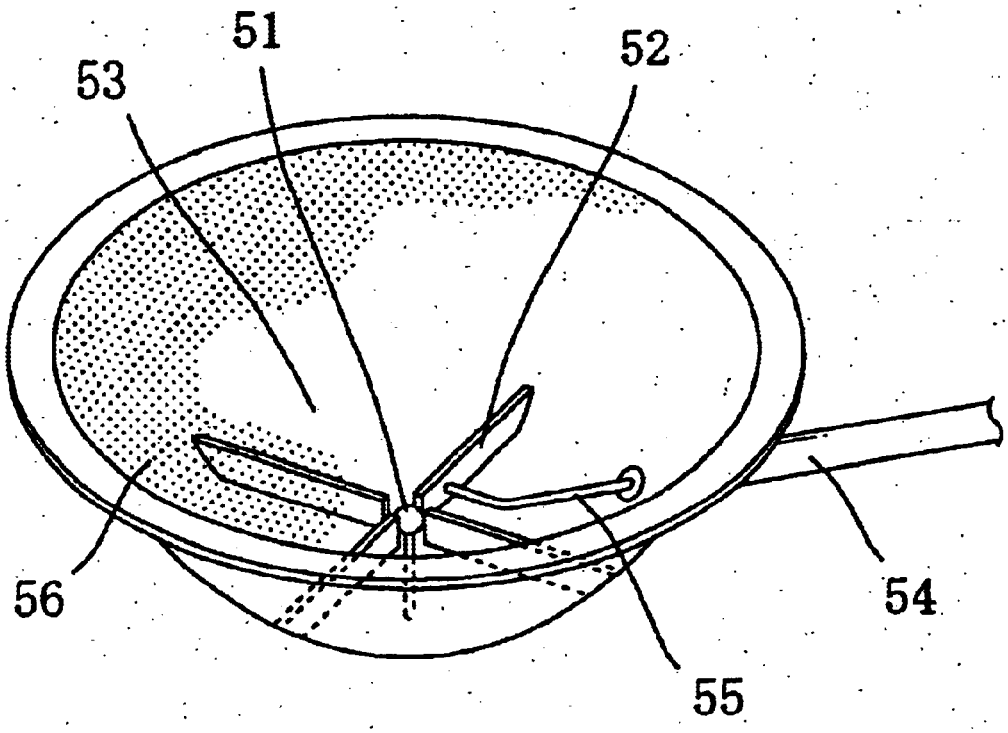
FIG. 10 is a schematic perspective view showing a conventional electrodeless discharge lamp apparatus.

Compared with the structure shown in FIG. 10, the vanes 52 in FIG. 10 are not provided in the structure of this embodiment, so that this embodiment is advantageous in that the light radiated in the direction of the side of the electrodeless discharge lamp 1 is not shielded. Consequently, compared with the system using the side resonators (vane-type resonators), the amount of light increases in this embodiment, which can improve the light utilization ratio and provide less non-uniformly distributed light. Moreover, discharge plasma of the electrodeless discharge lamp 51 extends in the direction perpendicular to the central axis of the reflecting mirror 53 in the structure shown in FIG. 10, whereas discharge plasma of the electrodeless discharge lamp 1 extends in the direction of the central axis of the metal reflecting mirror 3 in the structure of this embodiment. Therefore, the amount of light that is radiated to the reflecting mirror 3 increases and thus the light utilization ratio in the optical system through the metal reflecting mirror 3 can be further improved.

It is very difficult and unrealistic to produce the microwave resonator 10 with various shapes, for example, by molding them one by one, in order to match the resonance frequency of the microwave resonator 10 in the electrodeless discharge lamp of this embodiment to the desired frequency and to examine it with experiments. In order to design such a resonator of a complex shape having a large number of parameters, finite element analysis with a calculator is useful. The inventors of the present application conducted analysis using a finite element method. The results of the analysis will be described below.

Figure 3:
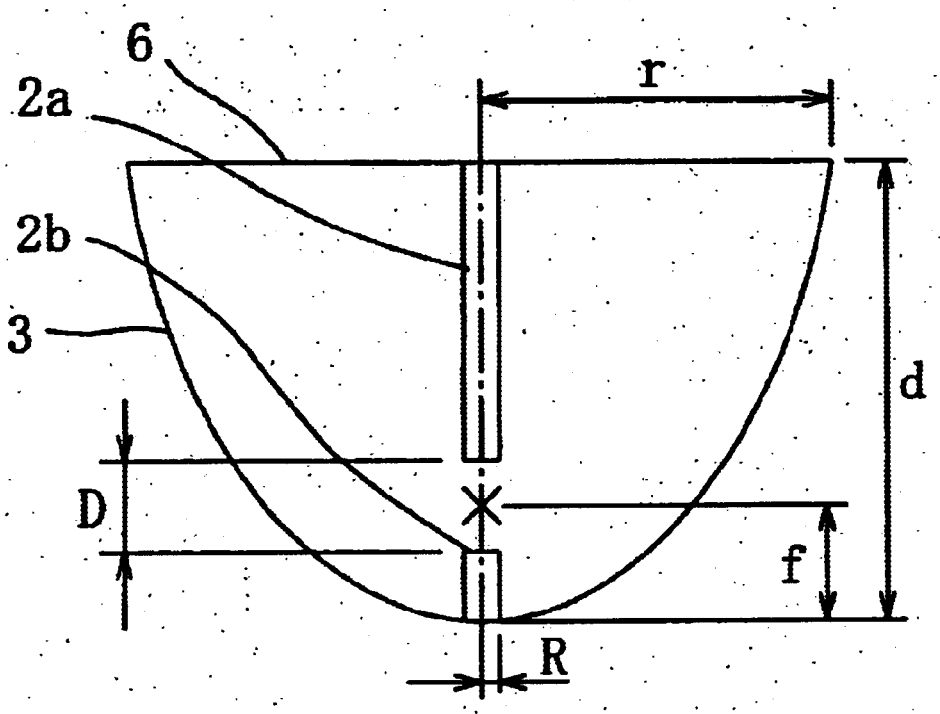
FIG. 3 is a cross-sectional view for illustrating analysis parameters of the microwave resonator.

FIG. 3 shows the size parameters of a model of the finite element method used for analysis. The parameters necessary to design the metal reflecting mirror 3 are the distance f to the focal point, the height d, and the radius r of the opening. The parameters for the opposing external electrodes 2*a*, 2*b* are the radius R and the gap distance D. Table 1 shows the results of an analysis with respect to models with some of the above parameters varied.

TABLE 1

| CASE | Size (mm) | | | | | Resonance Frequency |
|---|---|---|---|---|---|---|
| No. | d | r | f | D | R | (GHz) |
| 1 | 30 | 30 | 12 | 8 | 1.5 | 3.50 |
| 2 | 40 | 30 | 10 | 8 | 1.5 | 2.50 |
| 3 | 50 | 30 | 8 | 8 | 1.5 | 1.78 |
| 4 | 40 | 30 | 10 | 6 | 1.5 | 2.40 |
| 5 | 40 | 30 | 10 | 10 | 1.5 | 2.62 |
| 6 | 40 | 30 | 10 | 8 | 0.5 | 2.48 |
| 7 | 40 | 30 | 10 | 8 | 2.5 | 2.41 |

In Cases No. 1, 2 and 3 in Table 1, the height d and the distance f to the focal point of the metal reflecting mirror 3 are varied as the parameters. The results of Cases No. 1, 2 and 3 indicate that the larger the height d is, the lower the resonance frequency is. The results of Cases No. 2, 4 and 5 indicate that the larger the gap distance D of the opposing external electrodes 2 is, the higher the resonance frequency is. Therefore, the resonance frequency can be d by utilizing the gap adjusting means 8 of FIG. 1.

Furthermore, the tendency of the cases where the radius R of the opposing external electrodes 2 is varied should be seen by comparing Cases No. 2, 6 and 7, but no specific tendency can be seen, and the difference in the resonance frequency is smaller than in the tendencies in the above-described two cases. Therefore, the change in the size of the opposing external electrodes 2 does not significantly affect the resonance frequency.

In general, the frequency used for microwave electrodeless discharge lamps is 2.45 GHz ISM band. Therefore, the optimal size can be determined based on experiments with actual microwave resonators produced based on the size of CASE No. 2 among the examples of Table 1.

Next referring to FIGS. 4A, 4B; 5A, 5B; 6A, 6B, the details of the analysis data shown in Table 1 will be described further.

Figure 4A:
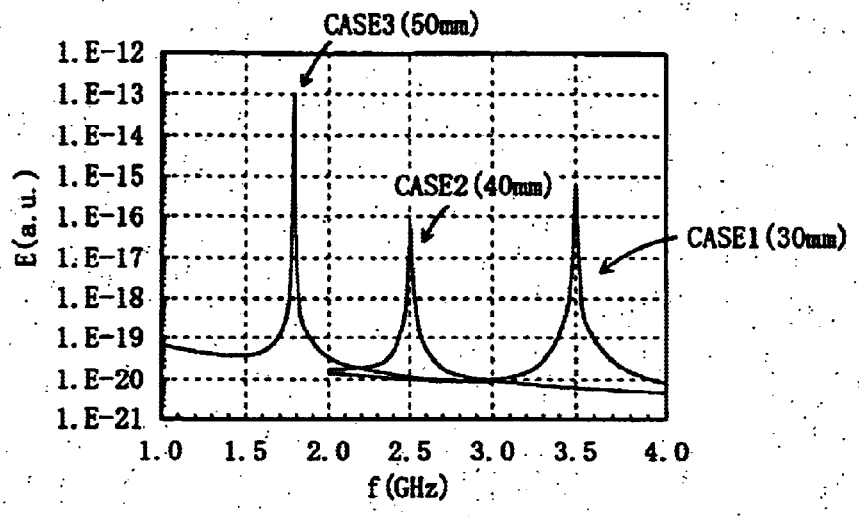
FIGS. 4A and 4B are graphs showing the simulation results obtained by varying the height d of a metal reflecting mirror as a parameter.
Figure 4B:
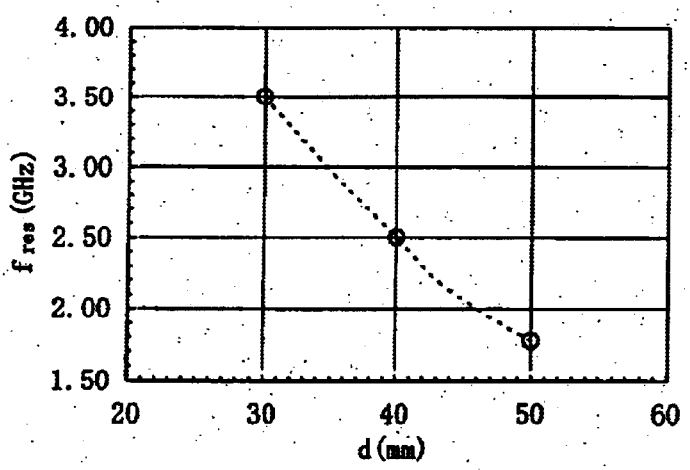

FIGS. 4A and 4B show the simulation results with the height d of the metal reflecting mirror 3 varied as the parameter. FIG. 4A shows the relationship between the resonance frequency f (GHz) and the resonant electric field E (arbitrary unit or "a.u.") with respect to each height d. FIG. 4*b* shows the relationship between the height d and the resonance frequency $f_{res}$ (GHz). CASE1, CASE2, and CASE3 respectively in FIG. 4A show the simulation results for the sizes of Cases No. 1, 2 and 3 of Table 1. The vertical axis of FIG. 4A is of a logarithmic scale as indicated by the E-designations.

It is understood from FIG. 4B that the larger the height d is, the lower the resonance frequency is, as described in the description of Table 1. It is also found that the magnitude of the height d contributes most to the change in the resonance frequency than other parameters. It seems that when the height d is changed, the cross-sectional area of the metal reflecting mirror 3 is changed, so that the height has large influence. Therefore, it is desirable to give sufficient consideration to the setting of the parameter of the height d. Among CASE1, 2, and 3, it is convenient to design based on the lamp of CASE2 whose resonance frequency is closest to 2.45 GHz.

Figure 5A:
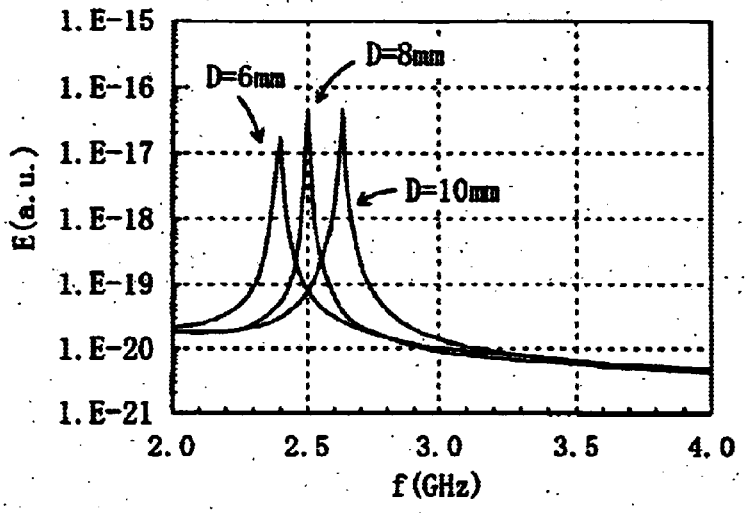
FIGS. 5A and 5B are graphs showing the simulation results obtained by varying the gap distance D as a parameter.
Figure 5B:
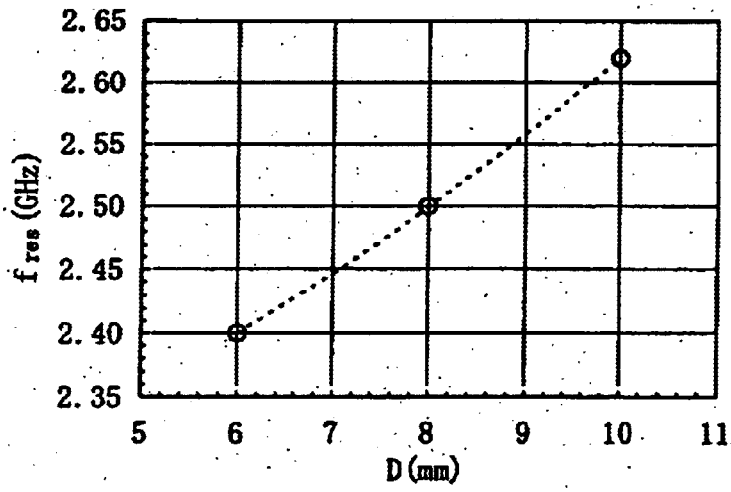

FIGS. 5A and 56 show the simulation results with the gap distance D varied as the parameter. FIG. 5A shows the relationship between the resonance frequency f (GHz) and the resonant electric field E (arbitrary unit or "a.u.") with respect to each gap distance D. FIG. 5B shows the relationship between the gap distance D and the resonance frequency $f_{res}$ (GHz). D=6 mm, 8 mm, and 10 mm respectively in FIG. 5A show the simulation results for the sizes of Cases No. 4, 2 and 5 of Table 1, respectively. The vertical axis of 5A is of a logarithmic scale as indicated by the E designations.

It is understood from FIG. 5B that the larger the gap distance D is, the higher the resonance frequency is. It is also found that it is preferable to set the gap distance D in the range of 6 to 8 mm in order to make the resonance frequency be in the vicinity of 2.45 GHz.

Figure 6A:
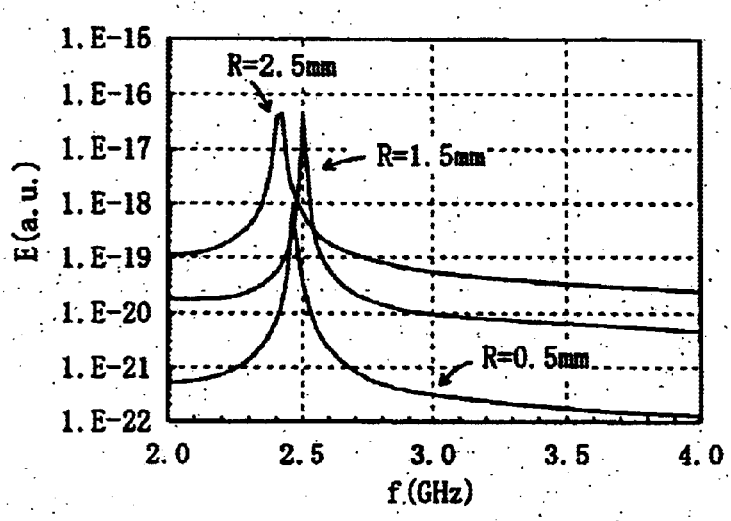
FIGS. 6A and 6B are graphs showing the simulation results obtained by varying the radius R of the opposing external electrodes as a parameter.
Figure 6B:
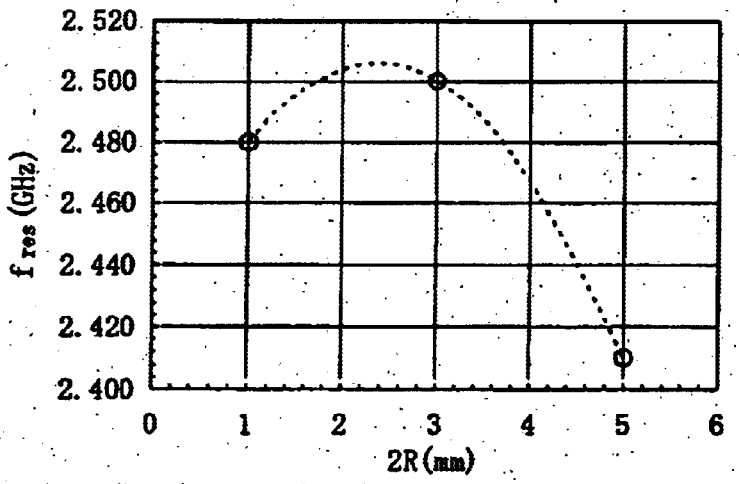

FIGS. 6A and 6B show the simulation results with the radius R of the opposing external electrodes 2 varied as the parameter. FIG. 6A shows the relationship between the resonance frequency f (GHz) and the resonant electric field E (arbitrary unit or "a.u.") with respect to each radius R (radius). FIG. 6B shows the relationship between the diameter 2R (diameter) and the resonance frequency $f_{res}$ (GHz). R=0.5 mm, 1.5 mm, and 2.5 mm respectively in FIG. 6A show the simulation results for the sizes of Cases No. 6, 2 and 7 of Table 1, respectively. The vertical axis of FIG. 6A is of a logarithmic scale as indicated by the E-designations.

It is understood from FIGS. 6A and 6B that the resonance frequency does not significantly depend on the thickness, and the degree of freedom of the radius R is comparatively large.

Figure 7:
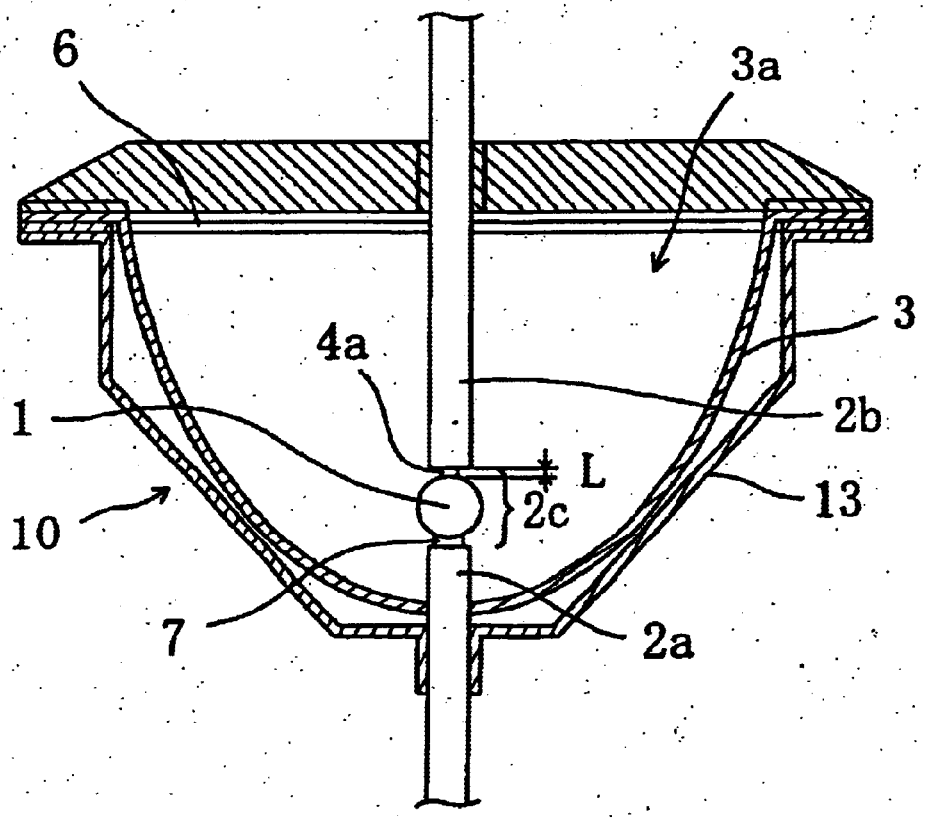
FIG. 7 is a schematic cross-sectional view showing another structure of the electrodeless discharge lamp apparatus of Embodiment 1 of the present invention.

Next, FIG. 7 shows the structure of an electrodeless discharge lamp apparatus produced by the inventors of the present application. The electrodeless discharge lamp apparatus shown in FIG. 7 has a size corresponding to that of CASE No. 2 in Table 1. That is to say, it is an electrodeless discharge lamp having d=40, r=30, f=10, D=8, and R=1.5 in the parameters shown in FIG. 3.

The electrodeless discharge lamp 1 shown in FIG. 7 is made of spherical hollow quartz glass, and the outer diameter and the inner diameter of the sphere is 6 mm and 4 mm, respectively. The electrodeless discharge lamp 1 encloses InBr (0.4 mg/0.033 cc) and Ar gas (50 Torr; about 6670 Pa), and does not contain mercury (Hg). In other words, the electrodeless discharge lamp 1 is a mercury-free lamp. InBr is used because InBr is a good luminous material having an emission spectrum covering the entire visible region, (i.e., exhibiting a spectrum close to solar light). Mercury can be enclosed as a luminous material. Instead of InBr, or in addition to InBr, other materials can be enclosed.

The structure shown in FIG. 7 has the following modifications from the structure shown in FIG. 1. In the structure shown in FIG. 7, the external electrode 2*b* serving also as a microwave coupler is provided on the upper side, and a coaxial line (an outer diameter of about 4 mm) is used as the external electrode 2*b*. Then, a core line 4*a* (an outer diameter of about 1 mm) of the coaxial line is projected from the end face of the external electrode 2*b*. This projected portion acts as an antenna. The length of this projection is referred to as the antenna projection length (L). On the lower side, the external electrode 2*a* serving also as supporting means 7 for supporting the electrodeless discharge lamp 1 is provided. The external electrode 2*a* is a hollow copper tube (an outer diameter of about 4 mm), and a supporting rod 7 for supporting the electrodeless discharge lamp 1 is inserted in the copper tube. This supporting rod 7 is made of quartz glass, but also can be made of ceramics having excellent heat resistance. The metal reflecting mirror 3 is an aluminum reflection mirror, and a supporting member 13 is provided in the outside thereof. As in the structure shown in FIG. 1, a metal mesh 6 is provided in the opening 3*a* of the reflecting mirror 3.

Figure 8A:
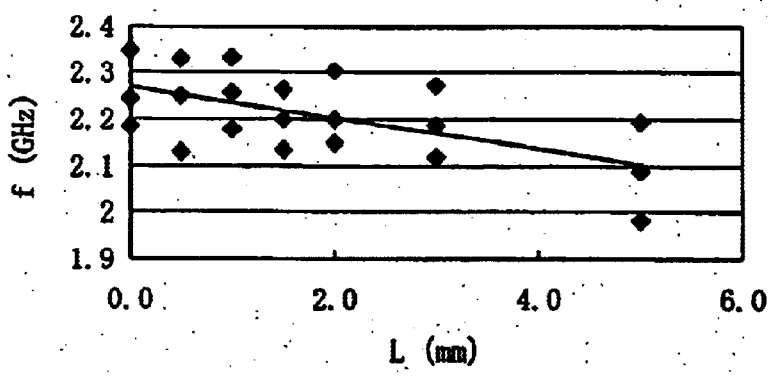
FIG. 8A is a graph showing the relationship between the antenna projection length L and the resonance frequency f.
Figure 8B:
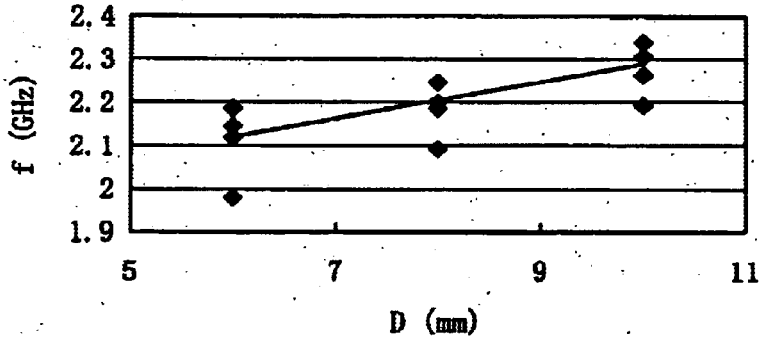
FIG. 8B is a graph showing the relationship between the distance D between electrodes and the resonance frequency f.
Figure 8C:
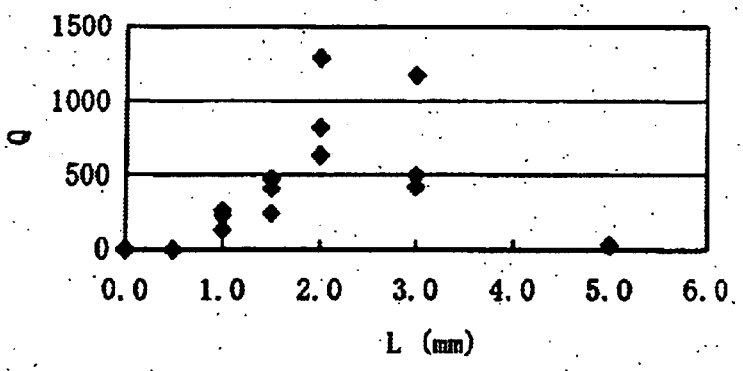
FIG. 8C is a graph showing the relationship between the antenna projection length L and the Q value.

FIGS. 8A, 8B, 8C show the resonance frequency f (GHz) and the actually measured Q values when the antenna projection length L (mm), the distance between the electrodes (gap distance) D in the electrodeless discharge lamp apparatus shown in FIG. 7 are varied. FIG. 8A shows the relationship between the antenna projection length L (mm) and the resonance frequency f (GHz), and FIG. 8B shows the relationship between the distance between the electrodes D (mm) and the resonance frequency f(GHz). FIG. 8C shows the relationship between the antenna projection length L (mm) and the Q values.

As shown in FIG. 8A, it is found that the larger the antenna projection length L (mm) is, the lower the resonance frequency f (GHz) is. In other words, the resonance frequency f can be adjusted by the antenna projection length L. As shown in FIG. 8B, the smaller the distance between the electrodes D is, the lower the resonance frequency f (GHz)

is. Consequently, if the results of FIG. 8B are considered, increasing the antenna projection length L (mm) may correspond to reducing the distance between the electrodes D.

As shown in FIG. 8C, it is also found that the Q value is changed with the antenna projection length L. It is preferable that the antenna projection length L is 2.0 mm or more and 3.0 mm or less, which allows the Q value to be in a comparatively high range, because when the Q value is low, the lamp operation may become poor.

In this embodiment, a structure using one metal reflecting mirror having an ellipsoidal surface as the reflecting mirror 3 has been described. However, a secondary spherical reflecting mirror having the electrodeless discharge lamp 1 as its center can be provided in front of the ellipsoidal reflecting mirror. In the case where the secondary reflecting mirror is configured so as to have an opening in a portion in which light is condensed by the ellipsoidal surface of the reflecting mirror 3 and in the vicinity thereof, unnecessary light other than desired beam light from the metal reflecting mirror 3 can be returned to the metal reflecting mirror 3, and then the light can be emitted from the opening of the secondary reflecting mirror, so that the effective luminous flux can be increased. In other words, light that is emitted directly from the opening of the metal reflecting mirror 3 without being reflected at the metal reflecting mirror 3 might result in unnecessary light for the optical system. However, providing the secondary reflecting mirror can improve the effective luminous flux.

Furthermore, in this embodiment, an example with the reflecting mirror 3 has been described, but the present invention is not limited thereto. A reflecting mirror having a structure in which the inner surface of the reflecting mirror made of dielectric is covered with a conductive mesh or the like may be used. For example, a reflecting mirror in which an aluminum mesh pattern is formed on the inner surface of the reflecting mirror made of glass may be used. In this embodiment, a metal mesh is used as the conductive shield 6 for confining microwaves, but the present invention is not limited thereto. A conductive shield in which the inner surface (surface on the side of the reflecting mirror 3) of a translucent dielectric substrate (glass plate or ceramic plate) is covered with a conductive mesh may be used. Alternatively, a conductive shield in which an aluminum or copper mesh pattern or a conductive thin film of indium tin oxide (ITO) is formed on the inner surface of a translucent dielectric substrate may be used.

The electrodeless discharge lamp apparatus of this embodiment includes the electrodeless discharge lamp 1, the microwave resonator 10, and the microwave coupler (2*b* or 4*a*), and the microwave resonator 10 includes the two opposing external electrodes (2*a*, 2*b*) provided substantially on the central axis of the reflecting mirror 3. Therefore, the present invention can have excellent luminous intensity distribution properties in a simple structure, compared with the structure shown in 10. Moreover, the amount of light can be increased and thus the utilization efficiency of light can be improved. That is to say, the present invention is an the electrodeless discharge lamp apparatus that can provide larger optical output and less non-uniformly distributed light in a simpler structure, while it allows light emission in a small size. Since the electrodeless discharge lamp apparatus of this embodiment can realize a comparatively small light-emitting portion, it can be used suitably for applications in which it substantially can be utilized as a point light source. For example, the present invention can be used in a wide range as a light source for image projecting apparatus, illumination at sports stadiums or public squares, spot light, a light source for floodlight illuminating road signs, and general illumination. The electrodeless discharge lamp 1 has no electrode exposed in the bulb, so that it has an advantage in that the lamp life can be prolonged significantly, compared with a discharge lamp with electrodes.

Embodiment 2

Next, an electrodeless discharge lamp apparatus of Embodiment 2 of the present invention will be described with reference to FIG. 9. The electrodeless discharge lamp apparatus of this embodiment is different from the electrodeless discharge lamp of Embodiment 1 in that it is provided with a conductive cylinder 20. For simplification of description of this embodiment, the aspects different from those in Embodiment 1 will be mainly described, and description of the same aspects as in Embodiment 1 will be omitted or simplified.

Figure 9:
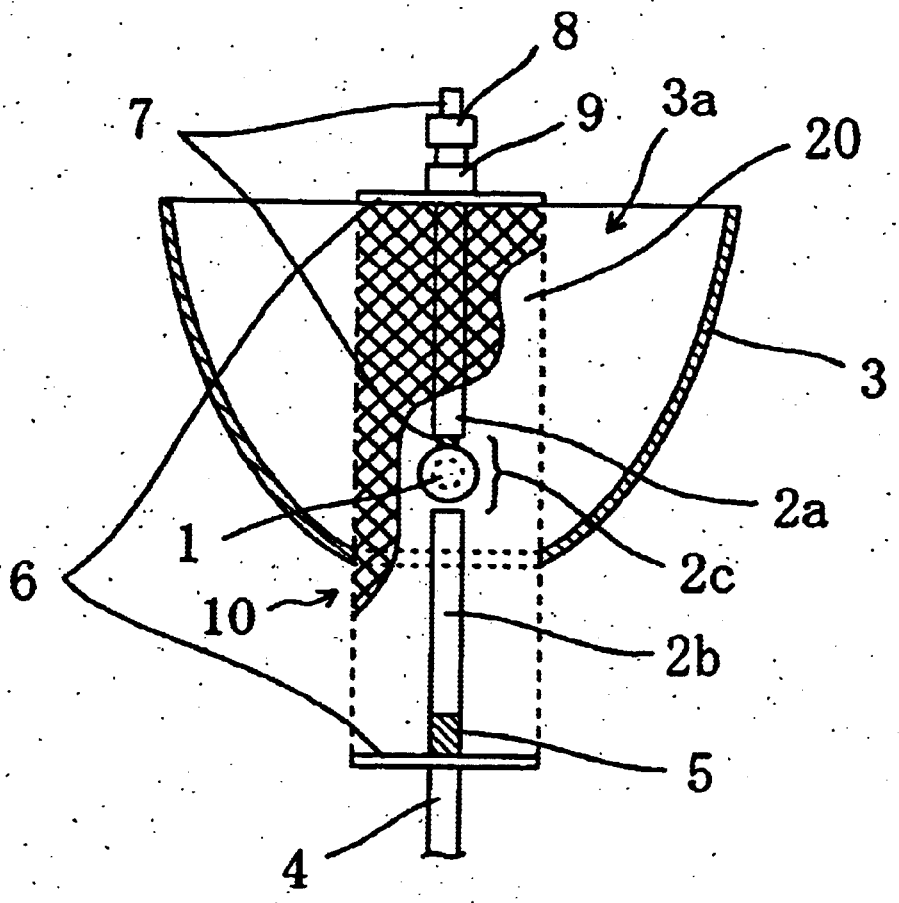
FIG. 9 is a schematic cross-sectional view showing a structure of an electrodeless discharge lamp apparatus of Embodiment 2 of the present invention.

FIG. 9 schematically shows a cross-sectional structure of a microwave resonator of this embodiment and an electrodeless discharge lamp apparatus using the same.

The microwave resonator 10 shown in FIG. 9 includes a conductive cylinder 20 made of a cylindrical metal mesh, and both ends of the conductive cylinder 20 are closed with metal shields 6. A portion of the conductive cylinder 20 is disposed in a hole formed substantially on the central axis of the ellipsoidal surface-shaped reflecting mirror 3. Opposing external electrodes (2*a*, 2*b*) made of a metal such as aluminum are provided substantially on the central axis of the conductive cylinder 20, and a gap 2*c* is present between the opposing external electrodes 2*a* and 2*b*. The gap 2*c* includes the focal point of the ellipsoidal surface of the reflecting mirror 3, and an electrodeless discharge lamp 1 is provided on the focal point of the reflecting mirror 3, that is, in the gap 2*c*. Moreover, the electrodeless discharge lamp 1 is provided substantially on the central axis of the conductive cylinder 20.

As in Embodiment 1, a supporting rod 7 for supporting the electrodeless discharge lamp 1 penetrates the inside of the external electrode 2*a*, and this is secured with a fastener 9. In addition, a position adjuster 8 for adjusting the position of one of the external electrodes 2*a* from the outside of the microwave resonator is provided. This position adjuster (gap adjusting means) 8 can be, for example, a screw or a flat spring, which makes it possible to move the position of the external electrode 2*a* in the direction of the axis while maintaining electrical contact. Thus, the distance of the gap 2*c* can be changed by the position adjuster (gap adjusting means) 8, and consequently the resonance frequency of the microwave resonator 10 can be adjusted.

The core line of the coaxial line 4 is in electrical contact with of the external electrode 2*b*. The coaxial line 4 is coupled to the external electrode 2*b* via an insulator 5, and therefore the outer conductor of the coaxial line 4 and one of the external electrodes 2*b* are insulated from each other. The external electrode 2*b* serves as an antenna, which is a microwave coupler.

Hereinafter, the operation of the electrodeless discharge lamp apparatus configured in the above-described manner will be described. The microwave energy Ser. No. 10/011, 587 generated by the microwave oscillator propagates through the coaxial line 4, and is coupled to the microwave resonator through one of the external electrodes 2*b* serving also as a microwave coupler. In this case, when the sizes of the conductive cylinder 20 and the opposing external electrodes 2 are designed as appropriate such that the frequency of the microwaves to be coupled matches the frequency of the resonator, a resonant electric field can be obtained in the gap 2*c* of the opposing external electrodes 2*a*, 2*b* as in Embodiment 1. Therefore, when the electrodeless discharge lamp 1 is provided in the gap 2*c* of the opposing external electrodes 2, the luminous material in the electrodeless discharge lamp 1 is excited for discharge and light emission. The light radiated by the discharge is released out through the shield 6 and reflected by the reflecting mirror 3.

In the case of the structure of this embodiment, compared with the structure of Embodiment 1, since the reflecting mirror 3 is provided outside the microwave resonator (conductive cylinder 20), the reflecting mirror 3 need not be necessarily conductive. Therefore, the reflecting mirror 3 can be made of a desired material, either metal or dielectric. Furthermore, since the shape of the reflecting mirror 3 does not affect the resonance frequency of the microwave resonator, one design of the microwave resonator can cope with a large number of reflecting mirror shapes, so that the degree of freedom in the optical design can be increased.

In this embodiment, an example where the conductive cylinder 20 has a cylindrical shape has been described, but other shapes such as a rectangle can be also used. Furthermore, the opposing external electrodes (2*a* and 2*b*) can be configured as shown in FIG. 7.

In Embodiments 1 and 2 described above, an example where the reflecting mirror 3 has an ellipsoidal surface has been described, but reflecting mirrors having various other shapes such as a parabolic surface, a spherical surface or angular elliptical surface can be used as well. In Embodiments 1 and 2, since one of the external electrodes 2*a* is used as the supporting means of the electrodeless discharge lamp 1, the embodiments are shown in the form where the supporting rod 7 extending from the electrodeless discharge lamp 1 is included therein. However, the external electrode 2*a* may be included inside the supporting rod.

Furthermore, Embodiments 1 and 2 has shown a structure where one of the external electrodes 2*a* is used as the supporting means of the electrodeless discharge lamp, and the other external electrode 2*b* is used as a microwave coupler. However, the present invention is not limited to this structure, and a microwave coupler and electrodeless discharge lamp supporting means can be provided completely apart from the opposing external electrodes 2. For example, the supporting means can be provided on the side. Moreover, a loop antenna can be used as a microwave coupler. Since it is sufficient that the microwave coupler couples microwaves to the microwave resonator, the microwave coupler can be a slot antenna obtained by forming an opening in the microwave resonator, for example.

Furthermore, in Embodiments 1 and 2, an example where the electrodeless discharge lamp 1 is made of a spherical quartz glass has been described, but a cylindrical shape or an ellipsoidal shape, or translucent ceramic material can be used.

An example where the supporting rod 7 of the electrodeless discharge lamp is provided inside one of the external electrodes 2*a* has been described, but it can be modified to a structure where the supporting rod 7 is hollow, and a conductive starting probe 101 is provided therein. In the case of such a structure ignition of the electrodeless discharge lamp 1 can be ensured by applying a high voltage pulse to the starting probe at the time of start.

Furthermore, cooling means 102 (FIG. 1) for cooling the electrodeless discharge lamp 1 can be provided in the electrodeless discharge lamp apparatus of Embodiments 1 and 2. For example, a cooler for blowing a cooling gas or like or a cool air blower may be provided in the electrodeless discharge lamp 1, or a cooling member for air-cooling may be brought in contact with the electrodeless discharge lamp 1. An instrument for cooling by propagating the heat of the electrodeless discharge lamp 1 to the outside may be attached. Alternatively, the electrodeless discharge lamp 1 during operation may be cooled, for example, by providing an opening in a portion of the reflecting mirror 3 as cooling means to suppress an increase in the temperature in the inside of the reflecting mirror 3. The limit of the power input to the electrodeless discharge lamp 1 can be raised by providing cooling means of the electrodeless discharge lamp.

In the above, the present invention has been described with preferable embodiments, but this description does not limit the present invention and various modifications are possible.

What is claimed is:

1. An electrodeless discharge lamp apparatus comprising:

a) an electrodeless discharge lamp having no electrode exposed inside a discharge bulb;

b) a microwave resonator; and c) a microwave coupler for coupling microwave energy to the microwave resonator, wherein the microwave resonator includes:

a conductive reflecting mirror having an opening;

a conductive shield covering the opening of the reflecting mirror and transmitting light in at least a portion thereof; and two opposing external electrodes provided substantially on a central axis of the reflecting mirror, a distance adjuster for adjusting the distance between the opposing external electrodes external of the microwave resonator;

the electrodeless discharge lamp is disposed between the opposing external electrodes, a focal point of the reflecting mirror is positioned between the opposing external electrodes, and when microwave energy is supplied to the microwave resonator via the microwave coupler, a microwave resonant electric field occurs between the opposing external electrodes, whereby discharge of the electrodeless discharge lamp occurs.

2. The electrodeless discharge lamp apparatus according to claim 1, comprising a wave guide connected to the microwave coupler, wherein the wave guide has a function to propagate microwaves generated by a microwave oscillator.

3. The electrodeless discharge lamp apparatus according to claim 1, wherein one of the opposing external electrodes serves also as the microwave coupler.

4. The electrodeless discharge lamp apparatus according to claim 3, wherein said one of the opposing external electrodes is a coaxial line, and the microwave coupler is a coaxial core line portion projected from one end of the coaxial line.

5. The electrodeless discharge lamp apparatus according to claim 1, wherein one of the opposing external electrodes serves also as supporting means of the electrodeless discharge lamp.

6. The electrodeless discharge lamp apparatus according to claim 5, wherein a starting probe is provided inside the supporting means.

7. The electrodeless discharge lamp apparatus according to claim 1, wherein the reflecting mirror is of a shape with an ellipsoidal surface.

8. The electrodeless discharge lamp apparatus according to claim 1, further comprising cooling means for cooling the electrodeless discharge lamp.

9. An electrodeless discharge lamp apparatus comprising:

a) an electrodeless discharge lamp having no electrode exposed inside a discharge bulb;

b) a microwave resonator;

c) a microwave coupler for coupling microwave energy to the microwave resonator; and d) a reflecting mirror provided outside the microwave resonator, wherein the microwave resonator includes:

a conductive cylinder having an opening;

a conductive shield covering the opening of the conductive cylinder and transmitting light in at least a portion thereof; and two opposing external electrodes provided substantially on a central axis of the conductive cylinder, a distance adjuster for adjusting the distance between the opposing external electrodes external of the microwave resonator:

the electrodeless discharge lamp is disposed between the opposing external electrodes, a focal point of the reflecting mirror is positioned between the opposing external electrodes, and when microwave energy is supplied to the microwave resonator via the microwave coupler, a microwave resonant electric field occurs between the opposing external electrodes, whereby discharge of the electrodeless discharge lamp occurs.

10. The electrodeless discharge lamp apparatus according to claim 9, further comprising cooling means for cooling the electrodeless discharge lamp.

11. The electrodeless discharge lamp apparatus according to claim 9, wherein the reflecting mirror is of a shape with an ellipsoidal surface.

12. The electrodeless discharge lamp apparatus according to claim 1, wherein the electrodeless discharge lamp is provided substantially on a central axis of the reflecting mirror and provided substantially on a central axis of the conductive cylinder.

13. The electrodeless discharge lamp apparatus according to claim 9, wherein a starting probe is provided inside the supporting means.

14. The electrodeless discharge lamp apparatus according to claim 9, wherein one of the opposing external electrodes serves also as the microwave coupler.

15. The electrodeless discharge lamp apparatus according to claim 14, wherein said one of the opposing external electrodes is a coaxial line, and the microwave coupler is a coaxial core line portion projected from one end of the coaxial line.

16. The electrodeless discharge lamp apparatus according to claim 9, wherein one of the opposing external electrodes serves also as supporting means of the electrodeless discharge lamp.

* * * * *